US006057641A

United States Patent [19]

Yoshida et al.

[11] Patent Number: 6,057,641

[45] Date of Patent: May 2, 2000

[54] CATHODE-RAY TUBE WITH FIXING SPRINGS FOR COLOR SELECTION ELECTRODE

[75] Inventors: Akihiko Yoshida; Jun Yamazaki, both of Aichi, Japan

[73] Assignee: Sony Corporation, Tokyo, Japan

[21] Appl. No.: 08/246,140

[22] Filed: May 19, 1994

[30] Foreign Application Priority Data

May 20, 1993 [JP] Japan ..... 5-118535

[51] Int. Cl.[7] ..... H01J 63/02

[52] U.S. Cl. ..... 313/404

[58] Field of Search ..... 313/402, 404, 313/406, 407

[56] References Cited

U.S. PATENT DOCUMENTS

| | | | |
|---|---|---|---|
| 3,296,477 | 1/1967 | Shrader et al. | 313/407 |
| 3,671,794 | 6/1972 | Nakamura et al. | 313/406 |
| 4,652,792 | 3/1987 | Tokita et al. | 313/404 |
| 4,713,576 | 12/1987 | Misumi et al. | 313/402 |
| 4,866,333 | 9/1989 | Tokita et al. | 313/406 |
| 4,886,997 | 12/1989 | Inoue et al. | 313/406 |
| 5,021,707 | 6/1991 | Bauder | 313/402 |

*Primary Examiner*—Michael H. Day
*Attorney, Agent, or Firm*—Hill & Simpson

[57] ABSTRACT

A cathode-ray tube having a color-selecting electrode which is secured to a fluorescent glass panel by fitting fixing springs provided on the color-selecting electrode to fixing pins, respectively, which are provided on the fluorescent glass panel. The fixing springs have a shape factor K in the range of from 10 $mm^3$/kg to 100 $mm^3$/kg, the shape factor K being given by $K$=(thickness)×(breadth)$^2$×(height)/(length)/(weight of color-selecting electrode)

Thus, it is possible to suppress the shift of the relative position of the fluorescent glass panel and the color-selecting electrode and minimize the incidence of product failures due to misregistration of colors.

3 Claims, 9 Drawing Sheets

Spring shape factor K = t · B · H/W/L
W = weight of color-selecting electrode

Spring shape factor K = t · B · H/W/L
W = weight of color-selecting electrode a : b = c : d = 10 : 9 ● : Measuring point

CATHODE-RAY TUBE WITH FIXING SPRINGS FOR COLOR SELECTION ELECTRODE

BACKGROUND OF THE INVENTION

1. Field of the Invention

The present invention relates to cathode-ray tubes having a color-selecting electrode. More particularly, the present invention relates to a cathode-ray tube in which misalignment between a color-selecting electrode and a fluorescent glass panel is reduced to thereby minimize misregistration of colors, and which has improved resistance to impact, e.g., drop impact.

2. Description of the Related Art

In a typical color cathode-ray tube, three electron beams corresponding to three primary color signals, for example, which are emitted from respective cathodes, are arranged to land on fluorescent materials formed on the inner side of a fluorescent glass panel, thereby allowing the fluorescent materials to emit light of the primary colors.

Accordingly, an error in landing of the electron beams on the fluorescent materials causes misregistration of colors. To minimize the color misregistration, an arrangement has heretofore been adopted in which the area between the fluorescent materials (phosphors) for the respective colors on the fluorescent screen is filled with carbon, which is a black, non-luminescent substance. The coating of carbon gives some allowance for electron beam landing and hence makes it possible to minimize the color misregistration and improve the color picture quality.

FIG. 1 is a perspective view of a cathode-ray tube having a color-selecting mechanism known as "aperture grille", i.e., what is known as the Trinitron (trade name) cathode-ray tube. As is well known, the cathode-ray tube shown in FIG. 1 is composed of the following constituent elements: an aperture grille (AG) 13 of vertical slots; a color-selecting electrode having a pair of upper and lower frame members (A-members) 8 that constitute an AG frame for supporting the aperture grille 13 and a pair of left and right frame members (B-members) 9 that also constitute the AG frame; a fluorescent glass panel 1 formed with fluorescent stripes; and a funnel 4 having an electron gun 3 sealed therein. The fluorescent glass panel 1 and the funnel 4 are integrated into one unit through a frit seal portion 10.

To secure the color-selecting electrode 2 to the fluorescent glass panel 1, fixing pins 5 are formed on the fluorescent glass panel 1, as shown in FIG. 2, which is a perspective view of the color-selecting electrode 2. On the other hand, spring holders 6 are welded to the side surfaces of the AG frame A-members 8 at respective positions close to the fixing pins 5, and springs 7 having openings are welded to the spring holders 6, respectively. The fixing pins 5 are fitted into the respective openings of the springs 7.

There are two known methods of securing the color-selecting electrode 2 to the fluorescent glass panel 1, that is, a 3-pin system and a 4-pin system, which are classified by the number of fixing pins 5 used.

FIG. 3(*a*) shows a 3-pin type fixing method wherein the color-selecting electrode 2 is secured at three positions on the fluorescent glass panel 1, that is, a pair of left and right end portions B and C, and a lower end portion A. The color-selecting electrode 2 is secured to the fluorescent glass panel 1 by fitting fixing pins 5 disposed at these three positions into the corresponding springs 7.

FIG. 3(*b*) shows a 4-pin, windmill type fixing method wherein fixing pins 5 are disposed at a total of four positions A, B, C and D, respectively, which are set on a pair of left and right end portions and a pair of upper and lower end portions of the fluorescent glass panel 1, and the color-selecting electrode 2 is secured to the fluorescent glass panel 1 by fitting the fixing pins 5 into the corresponding springs 7 in such a state that the springs 7 are disposed to face clockwise or counterclockwise like the vanes of a windmill.

FIG. 4 shows a 4-pin (3+1) type fixing method wherein fixing pins 5 are disposed at four positions A, B, C and D, respectively, on a pair of upper and lower end portions and a pair of left and right end portions of the fluorescent glass panel 1.

Carbon stripes and fluorescent stripes are formed on the fluorescent glass panel 1 as follows: With the color-selecting electrode 2 removed from the fluorescent glass panel 1, a carbon or fluorescent slurry containing a photosensitive material is coated on the inner surface of the fluorescent glass panel 1, and thereafter, exposure is carried out with the color-selecting electrode 2 secured to the fluorescent glass panel 1. This process is carried out for each of the fluorescent materials for the chosen primary colors. Thus, the fluorescent stripes for each color and the corresponding carbon stripes are formed by repeating the operation of attaching the color-selecting electrode 2 to the fluorescent glass panel 1 and detaching the former from the latter.

If the relative position of the fluorescent glass panel 1 and the color-selecting electrode 2 shifts when fluorescent stripes of a particular color are to be formed after carbon stripes have been formed, the allowance for electron beam landing decreases.

If the relative position of the fluorescent glass panel 1 and the color-selecting electrode 2 shifts after carbon stripes and fluorescent stripes of each color have been formed, the electron beam center offsets from the fluorescent stripe center. If the amount of offset increases and the shift of the relative position of the carbon stripes and the fluorescent stripes increases, a color which is different from a desired color is emitted. Thus, misregistration of colors occurs.

The relative position of the fluorescent glass panel 1 and the color-selecting electrode 2 depends on the accuracy of the attaching and detaching operation carried out during the fluorescent stripe forming process. It may also be changed by thermal deformation of the color-selecting electrode 2 during a thermal process, e.g., a frit seal process, an evacuation process, etc., which is carried out after the formation of the fluorescent material. If the shift of the relative position of the fluorescent glass panel 1 and the color-selecting electrode 2 is large, the completed cathode-ray tube suffers from the failure (color misregistration) due to the fact that the electron beam landing position shifts from the center of the target fluorescent stripes to a considerable extent.

The relative position of the fluorescent glass panel 1 and the color-selecting electrode 2 may also shift due to acceleration acting on the color-selecting electrode 2 when a drop impact is applied to the cathode-ray tube, for example, during transport after shipment. Accordingly, color misregistration occurring during the delivery of the products also gives rise to a problem.

SUMMARY OF THE INVENTION

In view of the above-described problems of the related art, it is an object of the present invention to provide a cathode-ray tube which is designed so that the shift of the relative position of the fluorescent glass panel and the color-selecting electrode is suppressed to thereby minimize the incidence of product failures due to misregistration of colors, while maintaining excellent impact resistance.

To attain the above-described object, the present invention provides a cathode-ray tube having a color-selecting electrode which is secured to a fluorescent glass panel by fitting fixing springs provided on the color-selecting electrode to fixing pins, respectively, which are provided on the fluorescent glass panel, wherein the fixing springs have a shape factor K in the range of from 10 $mm^3$/kg to 100 $mm^3$/kg.

In the present invention, the shape factor K of the fixing springs is given by $$K=(\text{thickness})\times(\text{breadth})^2\times(\text{height})/(\text{length})/(\text{weight of color-selecting electrode}).$$

According to the present invention, the fixing springs which are disposed on the upper and lower ends of the color-selecting electrode preferably have a shape factor K in the range of from 10 $mm^3$/kg to 80 $mm^3$/kg.

Further, according to the present invention, the fixing springs which are disposed on the left and right sides of the color-selecting electrode preferably have a shape factor K in the range of from 20 $mm^3$/kg to 100 $mm^3$/kg.

In actual design of the above-described fixing springs, there are restrictions in terms of the color-selecting electrode size which are placed of necessity to minimize the size and weight of the fluorescent glass panel. There are also restrictions in terms of the color-selecting electrode size placed in order to maximize the actual area for forming a screen.

Among these restrictions, the spring shape factor K is taken into consideration in the present invention, which is obtained from the thickness t (mm), breadth B (mm), length L (mm) and height H (mm) of fixing springs (see FIG. 5) in a state of not being fitted to the fixing pins of the fluorescent glass panel, and the weight W (kg) of the color-selecting electrode including the weights of the springs and the spring holders. According to the present invention, the color-selecting electrode is provided with fixing springs having a shape factor K limited in the range of from 10 $mm^3$/kg to 100 $mm^3$/kg:

$$K=(t)\times(B)^2\times(H)\div(L)\div(\text{weight of color-selecting electrode})$$

By providing the color-selecting electrode with fixing springs having a predetermined spring shape factor K, it is possible to minimize the shift of the relative position of the fluorescent glass panel and the color-selecting electrode caused by the color-selecting electrode attaching and detaching during the fluorescent stripe forming process and thermal deformation of the color-selecting electrode during a thermal process, e.g., a frit seal process, an evacuation process, etc., which is carried out after the fluorescent stripe forming process. It is also possible to minimize the shift of the relative position of the fluorescent glass panel and the color-selecting electrode caused by acceleration acting on the color-selecting electrode when drop impact is applied to the cathode-ray tube during transport after shipment.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which.

DESCRIPTION OF THE PREFERRED EMBODIMENTS

One embodiment of the present invention will be described below in detail with reference to the accompanying drawings.

With regard to the arrangement of a cathode-ray tube having a color-selecting electrode to which the present invention is applied, and the method of attaching the color-selecting electrode to the fluorescent glass panel, the above-described arrangement and attaching method may be applied. Therefore, description thereof is omitted.

Prior to the description of the present invention, a method of measuring the amount of offset of the electron beam center from the fluorescent stripe center, which is used in the following Examples, will be explained below.

Figure 6:
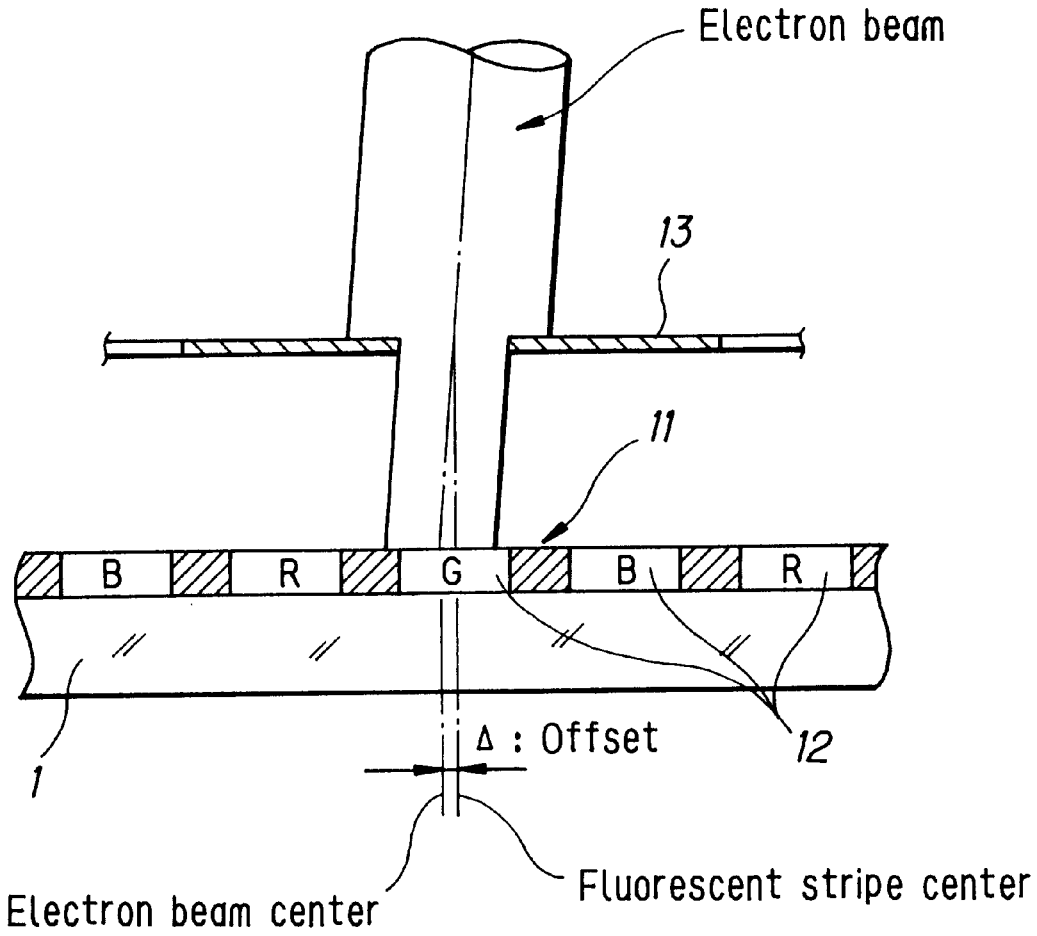
FIG. 6 shows the offset of the electron beam center from the fluorescent stripe center.

FIG. 6 illustrates the offset (the amount of offset Δ) of the electron beam center from the fluorescent stripe center. In the figure, reference numeral 11 denotes carbon stripes, and 12 fluorescent stripes of three colors, i.e., R (red), G (green) and B (blue), which are formed on the reverse surface of a glass panel. In this specification, the glass panel formed with the carbon stripes 11 and the fluorescent stripes 12 is referred to as "fluorescent glass panel 1". An aperture grille (AG) 13 serves as a color-selecting electrode. FIG. 6 shows a state where an electron beam is applied to one G stripe in the fluorescent stripes 12.

The amount of offset Δ of the electron beam center from the fluorescent stripe center was obtained as follows: With the electron beam being oscillated in a green monochromatic state, the luminance was measured with a photosensor, and the amount of oscillation of the electron beam when the highest luminance was measured (i.e., when the electron beam center aligned with the center of the green fluorescent stripe) was determined to be the offset Δ.

Figure 7:
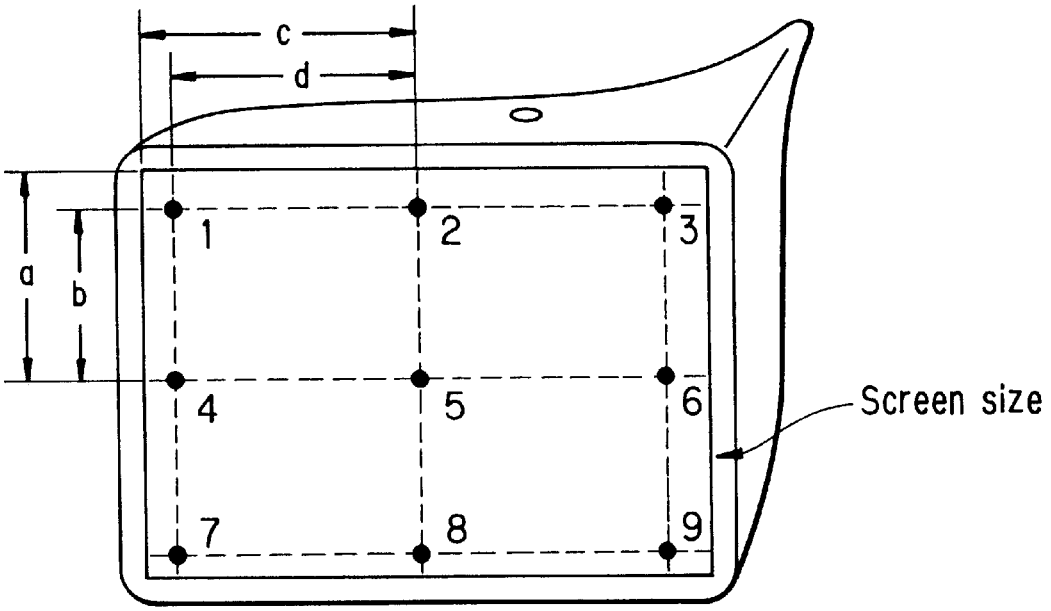
FIG. 7 shows positions on a screen where the amount of offset A of the electron beam center from the fluorescent stripe center is to be measured.

As shown in FIG. 7, offset measuring points were set at a total of 9 points of intersections (1 to 9) of three vertical, equally spaced imaginary lines and three horizontal, equally spaced imaginary lines on the screen. The measuring points at the ends of the screen were each arranged to define 90% of the screen size. Let us take the top left portion of the screen as an example. Assuming that the distance between the measuring points 1 and 4 is b, the distance between the measuring points 1 and 2 is d, and the distances from the measuring points 4 and 2 to the corresponding ends of the screen are a and c, respectively, the relationship between these distances is given by a:b=c:d=10:9

With regard to drop impact, each test cathode-ray tube was dropped with its screen facing downward from a height at which the maximum acceleration was 20 G, and the change in landing caused by the drop test was measured at the above-mentioned 9 points. The maximum value of the amounts of change thus measured was determined to be drop impact characteristic.

Figure 8A:
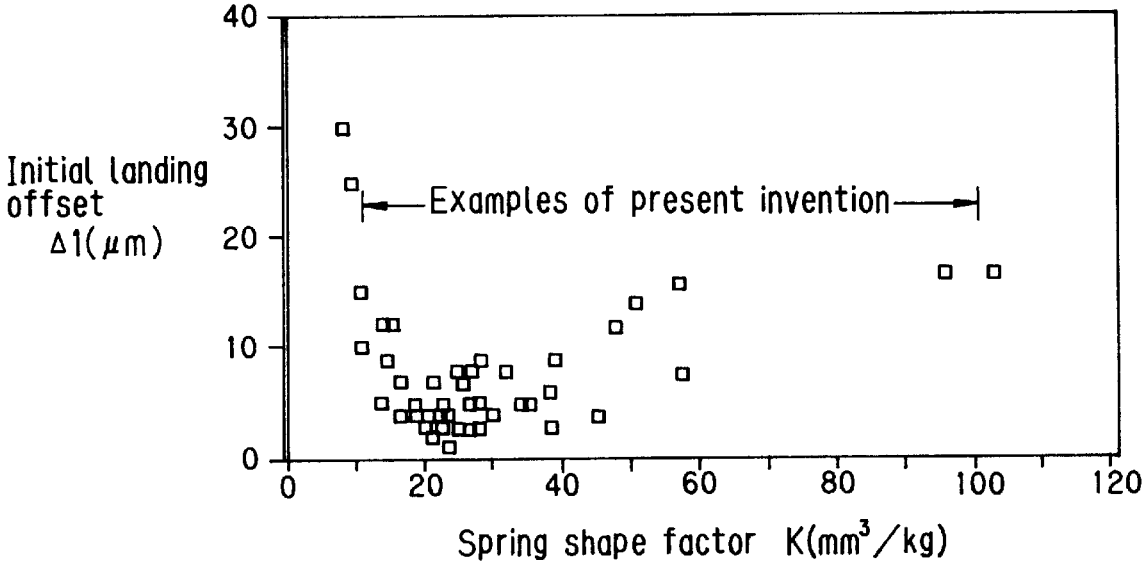
FIGS. 8(*a*) and 8(*b*) are graphs showing the relationship between the spring shape factor K according to the present invention and the amount of initial offset Δ1 of the electron beam center from the fluorescent stripe center.
Figure 8B:
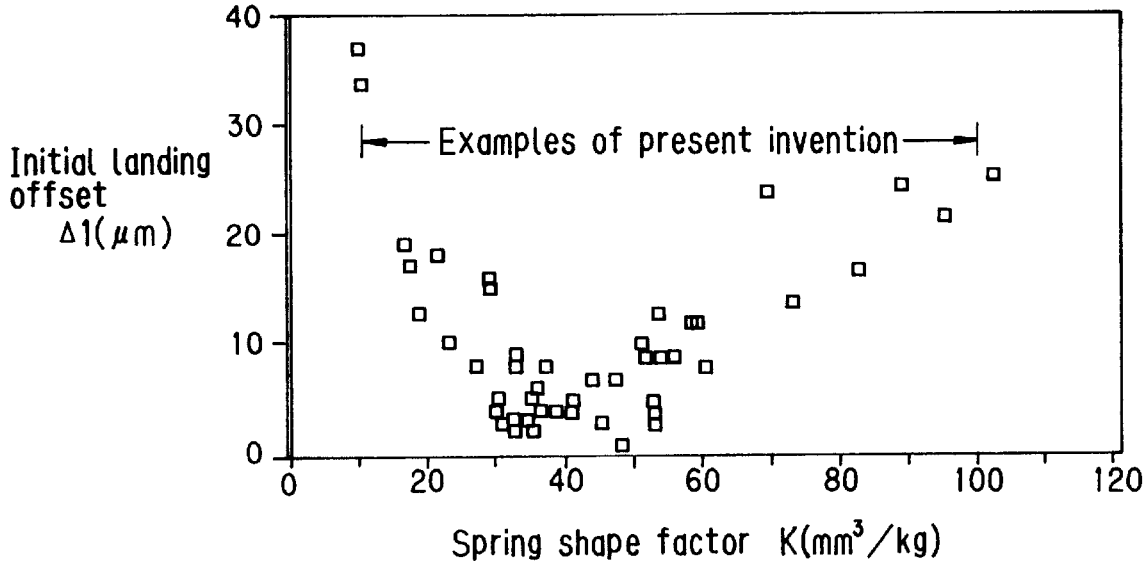
Figure 9A:
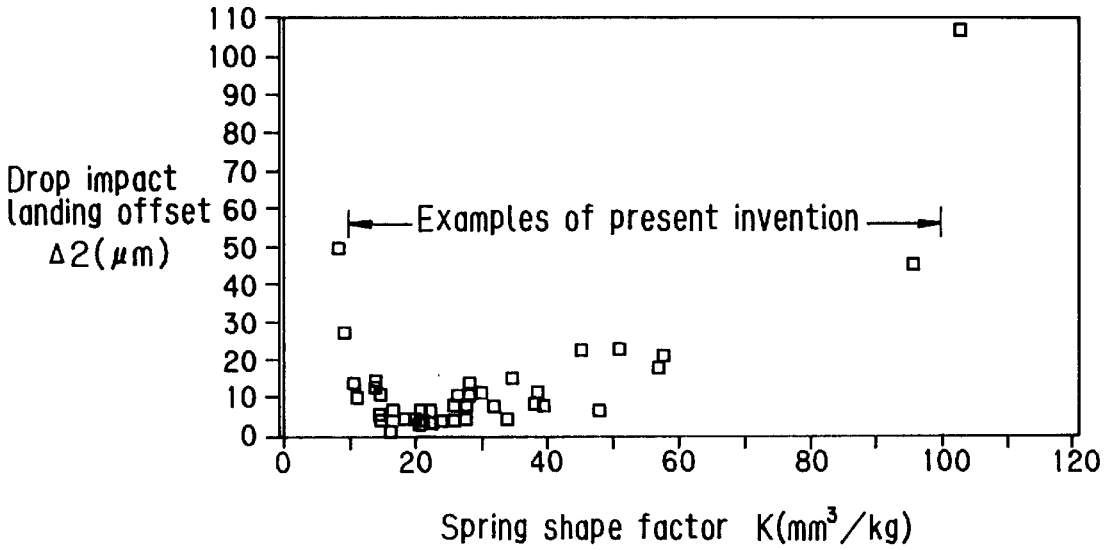
FIGS. 9(*a*) and 9(*b*) are graphs showing the relationship between the spring shape factor K according to the present invention and the amount of offset Δ2 of the electron beam center from the fluorescent stripe center caused by a drop impact.
Figure 9B:
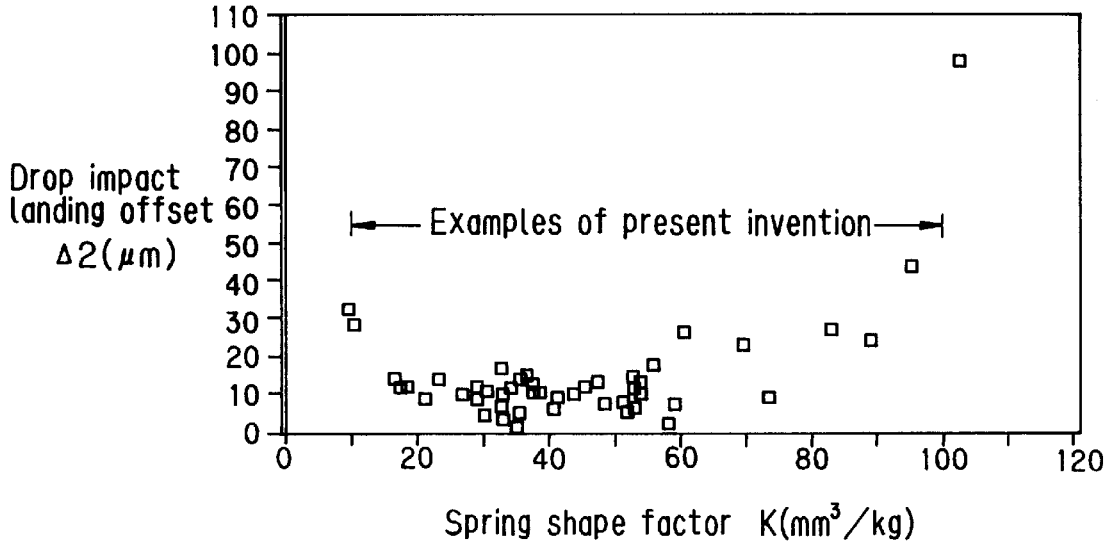

Measurement was carried out on cathode-ray tubes of various sizes by the above-described methods. Tables 1 and 2 and FIGS. 8(*a*), 8(*b*), 9(*a*) and 9(*b*) show the results of measurement for the offset Δ1 (the initial offset at the time of completion of the products) of the electron beam center from the fluorescent stripe center and the offset Δ2 after the drop impact test with respect to the spring shape factor K. FIGS. 8(*a*) and 9(*a*) show the results of measurement for the fixing springs 7 provided at the positions A and D, whereas FIGS. 8(*b*) and 9(*b*) show the results of measurement for the fixing springs 7 provided at the positions B and C.

TABLE 1

Relationship between spring shape factor K and Δ (springs at upper and lower ends A and D)

| | No. | Type | Weight | Thickness | Breadth | Length | Height | K | Δ1 | Δ2 | Remarks |
|---|---|---|---|---|---|---|---|---|---|---|---|
| Present Invention | 1 | 14 | 1.15 | 0.55 | 18 | 65 | 4.5 | 10.73 | 15 | 14 | |
| | 2 | 14 | 1.15 | 0.55 | 21 | 65 | 4.5 | 14.60 | 12 | 11 | |
| | 3 | 14 | 1.15 | 0.65 | 21 | 63 | 4.7 | 18.60 | 4 | 5 | * |
| | 4 | 14 | 1.15 | 0.65 | 25 | 63 | 4.7 | 26.35 | 5 | 9 | |
| | 5 | 14 | 1.15 | 0.65 | 32 | 63 | 4.9 | 45.02 | 4 | 23 | |
| | 6 | 15 | 1.3 | 0.6 | 18 | 65 | 4.7 | 10.81 | 10 | 11 | |
| | 7 | 15 | 1.3 | 0.6 | 21 | 65 | 4.7 | 14.72 | 9 | 4 | |
| | 8 | 15 | 1.3 | 0.65 | 21 | 63 | 4.7 | 16.45 | 4 | 1 | * |
| | 9 | 15 | 1.3 | 0.65 | 25 | 63 | 4.7 | 23.31 | 1 | 4 | |
| | 10 | 15 | 1.3 | 0.7 | 30 | 63 | 5 | 38.46 | 3 | 12 | |
| | 11 | 17-1 | 1.65 | 0.55 | 21 | 70 | 6.5 | 13.65 | 5 | 13 | |
| | 12 | 17-1 | 1.65 | 0.6 | 25 | 70 | 6.5 | 21.10 | 7 | 6 | |
| | 13 | 17-1 | 1.65 | 0.6 | 25 | 75 | 6.9 | 20.91 | 2 | 5 | * |
| | 14 | 17-1 | 1.65 | 0.55 | 27 | 75 | 6.9 | 22.36 | 3 | 8 | |
| | 15 | 17-1 | 1.65 | 0.55 | 30 | 75 | 6.9 | 27.60 | 5 | 9 | |
| | 16 | 17-1 | 1.65 | 0.6 | 30 | 75 | 6.9 | 30.11 | 4 | 12 | |
| | 17 | 17-2 | 1.8 | 0.6 | 25 | 70 | 6.9 | 20.54 | 4 | 3 | * |
| | 18 | 17-2 | 1.8 | 0.6 | 30 | 75 | 6.9 | 27.60 | 3 | 5 | |
| | 19 | 17-2 | 1.8 | 0.65 | 30 | 80 | 6.9 | 28.03 | 3 | 11 | |
| | 20 | 17-2 | 1.8 | 0.7 | 40 | 90 | 6.9 | 47.70 | 12 | 7 | |
| | 21 | 19 | 1.6 | 0.55 | 25 | 80 | 10 | 26.86 | 8 | 11 | |
| | 22 | 19 | 1.6 | 0.55 | 25 | 85 | 13.4 | 33.87 | 5 | 5 | |
| | 23 | 19 | 1.6 | 0.8 | 27 | 85 | 13.4 | 57.46 | 8 | 21 | * |
| | 24 | 20-1 | 2.7 | 0.6 | 25 | 85 | 10 | 16.34 | 7 | 7 | |
| | 25 | 20-1 | 2.7 | 0.6 | 25 | 75 | 10 | 18.52 | 5 | 5 | |
| | 26 | 20-1 | 2.7 | 0.65 | 27 | 85 | 9.7 | 20.03 | 3 | 5 | |
| | 27 | 20-1 | 2.7 | 0.7 | 27 | 80 | 9.5 | 22.44 | 3 | 4 | |
| | 28 | 20-1 | 2.7 | 0.65 | 27 | 85 | 9.7 | 20.03 | 4 | 4 | * |
| | 29 | 20-1 | 2.7 | 0.65 | 30 | 80 | 10 | 27.08 | 3 | 4 | |
| | 30 | 20-1 | 2.7 | 0.6 | 30 | 80 | 10 | 25.00 | 3 | 4 | |
| | 31 | 20-1 | 2.7 | 0.75 | 40 | 70 | 15 | 95.24 | 17 | 45 | |
| | 32 | 20-2 | 2.6 | 0.65 | 27 | 85 | 10 | 21.44 | 4 | 4 | * |
| | 33 | 20-2 | 2.6 | 0.8 | 27 | 85 | 9.7 | 25.60 | 7 | 4 | |
| | 34 | 20-2 | 2.6 | 0.65 | 30 | 85 | 9.7 | 25.68 | 3 | 8 | |
| | 35 | 20-2 | 2.6 | 0.8 | 30 | 85 | 12 | 39.10 | 9 | 8 | |
| | 36 | 21 | 1.81 | 0.65 | 22 | 85 | 11 | 22.49 | 5 | 2 | |
| | 37 | 21 | 1.81 | 0.7 | 25 | 85 | 13.4 | 38.11 | 6 | 9 | |
| | 38 | 21 | 1.81 | 0.8 | 27 | 85 | 13.4 | 50.80 | 14 | 23 | |
| | 39 | 21 | 1.81 | 0.8 | 27 | 85 | 15 | 56.86 | 16 | 18 | |
| | 40 | 25 | 3.47 | 0.85 | 32 | 98 | 13.5 | 34.55 | 5 | 16 | * |
| | 41 | 29 | 4.675 | 0.85 | 32 | 95 | 12 | 23.52 | 4 | 5 | |
| | 42 | 29 | 4.675 | 0.9 | 34 | 105 | 13.3 | 28.19 | 9 | 14 | * |
| | 43 | 29 | 4.675 | 0.9 | 34 | 105 | 15 | 31.79 | 8 | 8 | |
| | 44 | 34 | 6.9 | 1.1 | 30 | 115 | 11 | 13.72 | 12 | 15 | * |
| | 45 | 34 | 6.9 | 0.8 | 35 | 115 | 12 | 14.82 | 12 | 6 | |
| | 46 | 34 | 6.9 | 1.1 | 35 | 120 | 15 | 24.41 | 8 | 4 | |
| Comparative Examples | 47 | 14 | 1.15 | 0.6 | 16 | 65 | 4.5 | 9.25 | 25 | 28 | |
| | 48 | 15 | 1.3 | 0.6 | 16 | 65 | 4.5 | 8.18 | 30 | 50 | |
| | 49 | 19 | 1.6 | 0.8 | 35 | 80 | 13.4 | 102.5 | 17 | 107 | |

(Note): average values of N = 5 except for No. 48 (N = 3)

TABLE 2

Relationship between spring shape factor K and Δ (springs at upper and lower ends A and D)

| | No. | Type | Weight | Thickness | Breadth | Length | Height | K | Δ1 | Δ2 | Remarks |
|---|---|---|---|---|---|---|---|---|---|---|---|
| Present Invention | 1 | 14 | 1.15 | 0.6 | 18 | 75 | 9.4 | 21.19 | 18 | 9 | |
| | 2 | 14 | 1.15 | 0.65 | 20 | 75 | 9 | 27.13 | 8 | 11 | |
| | 3 | 14 | 1.15 | 0.7 | 23 | 81 | 9 | 35.78 | 6 | 15 | |
| | 4 | 14 | 1.15 | 0.7 | 23 | 80 | 9.4 | 37.84 | 4 | 11 | * |
| | 5 | 14 | 1.15 | 0.7 | 28 | 85 | 9.4 | 52.77 | 5 | 12 | |
| | 6 | 14 | 1.15 | 0.65 | 32 | 90 | 9.4 | 60.45 | 8 | 27 | |
| | 7 | 15 | 1.3 | 0.6 | 18 | 81 | 9.4 | 17.35 | 17 | 12 | |
| | 8 | 15 | 1.3 | 0.65 | 20 | 81 | 9.4 | 23.21 | 10 | 14 | |
| | 9 | 15 | 1.3 | 0.7 | 23 | 81 | 9.4 | 33.06 | 9 | 11 | * |
| | 10 | 15 | 1.3 | 0.75 | 23 | 81 | 9.4 | 35.42 | 2 | 5 | |
| | 11 | 15 | 1.3 | 0.65 | 28 | 81 | 10 | 48.40 | 1 | 8 | |
| | 12 | 17-1 | 1.65 | 0.6 | 25 | 90 | 13 | 32.83 | 3 | 4 | |
| | 13 | 17-1 | 1.65 | 0.6 | 25 | 90 | 13 | 32.83 | 2 | 7 | * |
| | 14 | 17-1 | 1.65 | 0.55 | 27 | 90 | 13 | 35.1O | 5 | 2 | |
| | 15 | 17-1 | 1.65 | 0.65 | 30 | 90 | 15 | 59.09 | 12 | 8 | |
| | 16 | 17-1 | 1.65 | 0.7 | 30 | 85 | 13 | 58.40 | 12 | 3 | |
| | 17 | 17-2 | 1.8 | 0.6 | 25 | 90 | 13 | 30.09 | 4 | 5 | * |
| | 18 | 17-2 | 1.8 | 0.6 | 30 | 75 | 13 | 52.00 | 9 | 6 | |
| | 19 | 17-2 | 1.8 | 0.65 | 30 | 80 | 13 | 52.81 | 3 | 7 | |
| | 20 | 17-2 | 1.8 | 0.7 | 40 | 85 | 13 | 95.16 | 22 | 45 | |
| | 21 | 19 | 1.6 | 0.55 | 27 | 80 | 13 | 40.72 | 4 | 7 | |
| | 22 | 19 | 1.6 | 0.65 | 25 | 80 | 13 | 41.26 | 5 | 9 | |
| | 23 | 19 | 1.6 | 0.8 | 27 | 85 | 13 | 55.75 | 9 | 18 | |
| | 24 | 19 | 1.6 | 0.8 | 27 | 88 | 20 | 82.84 | 17 | 28 | * |
| | 25 | 20-1 | 2.7 | 0.6 | 25 | 85 | 10 | 16.34 | 19 | 14 | |
| | 26 | 20-1 | 2.7 | 0.6 | 25 | 75 | 10 | 18.52 | 13 | 12 | |
| | 27 | 20-1 | 2.7 | 0.65 | 27 | 90 | 17.5 | 34.13 | 3 | 12 | |
| | 28 | 20-1 | 2.7 | 0.7 | 27 | 100 | 17.5 | 33.08 | 3 | 10 | * |
| | 29 | 20-1 | 2.7 | 0.65 | 27 | 80 | 17.5 | 38.39 | 4 | 11 | |
| | 30 | 20-1 | 2.7 | 0.65 | 25 | 90 | 17.5 | 29.26 | 16 | 12 | |
| | 31 | 20-1 | 2.7 | 0.7 | 30 | 90 | 17.5 | 45.37 | 3 | 13 | |
| | 32 | 20-1 | 2.7 | 0.75 | 40 | 100 | 20 | 88.89 | 25 | 25 | |
| | 33 | 20-2 | 2.6 | 0.65 | 27 | 85 | 17 | 36.45 | 4 | 16 | |
| | 34 | 20-2 | 2.6 | 0.8 | 27 | 90 | 17.5 | 43.62 | 7 | 11 | |
| | 35 | 20-2 | 2.6 | 0.7 | 30 | 90 | 17.5 | 47.12 | 7 | 14 | |
| | 36 | 20-2 | 2.6 | 0.8 | 30 | 90 | 17.5 | 53.85 | 9 | 11 | |
| | 37 | 21 | 1.81 | 0.65 | 22 | 85 | 15 | 30.67 | 5 | 11 | |
| | 38 | 21 | 1.81 | 0.7 | 25 | 85 | 18 | 51.19 | 10 | 8 | |
| | 39 | 21 | 1.81 | 0.8 | 27 | 88 | 20 | 73.23 | 14 | 10 | |
| | 40 | 21 | 1.81 | 0.8 | 27 | 90 | 15 | 53.70 | 13 | 14 | |
| | 41 | 25 | 3.47 | 1 | 34 | 120 | 25 | 69.40 | 24 | 24 | |
| | 42 | 29 | 4.675 | 1 | 36 | 110 | 21 | 52.92 | 4 | 15 | |
| | 43 | 29 | 4.675 | 1.1 | 34 | 125 | 13.3 | 28.94 | 15 | 9 | |
| | 44 | 29 | 4.675 | 1.1 | 34 | 125 | 15 | 32.64 | 8 | 17 | |
| | 45 | 34 | 6.9 | 1.2 | 32 | 115 | 20 | 30.97 | 3 | 11 | |
| | 46 | 34 | 6.9 | 1.2 | 35 | 120 | 21 | 37.28 | 8 | 13 | |
| Comparative Examples | 47 | 15 | 1.3 | 0.7 | 32 | 70 | 13 | 102.4 | 26 | 99 | |
| | 48 | 17-1 | 1.65 | 0.5 | 20 | 80 | 6.5 | 9.85 | 34 | 29 | |
| | 49 | 34 | 6.9 | 1 | 28 | 120 | 10 | 9.47 | 37 | 33 | |

(Note): average values of N = 5 except for No. 48 (N = 3)

In Examples relating to the upper and lower end positions A and D, shown in Table 1 and FIGS. 8(*a*) and 9(*a*), the spring configuration of the fixing springs 7 attached to the left and right end positions B and C was fixed in the conditions asterisked (*) in the remarks column in Table 2.

On the other hand, in Examples relating to the left and right end positions B and C, shown in Table 2 and FIGS. 8(*b*) and 9(*b*), the spring configuration of the fixing springs 7 attached to the upper and lower end positions A and D was fixed in the conditions asterisked (*) in the remarks column in Table 1.

Figure 1:
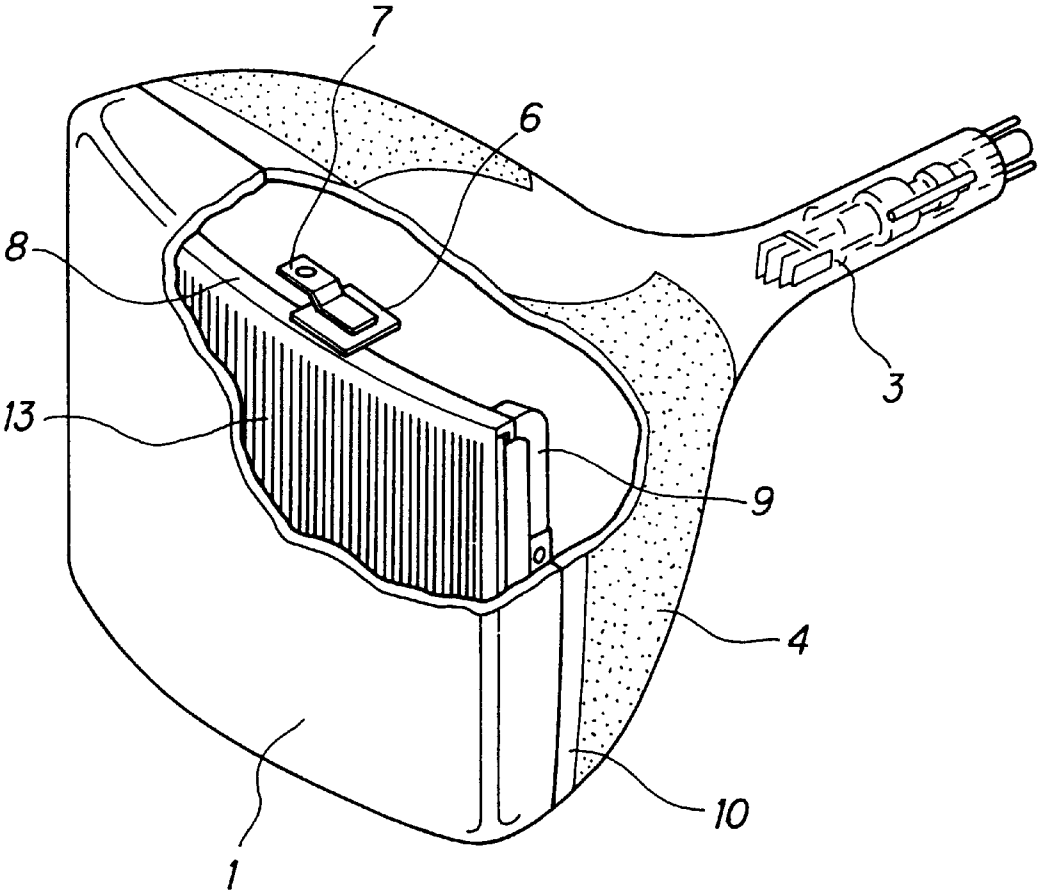
Fig. 1 (PRIOR ART)
FIG. 1 is a perspective view of a cathode-ray tube.
Figure 2:
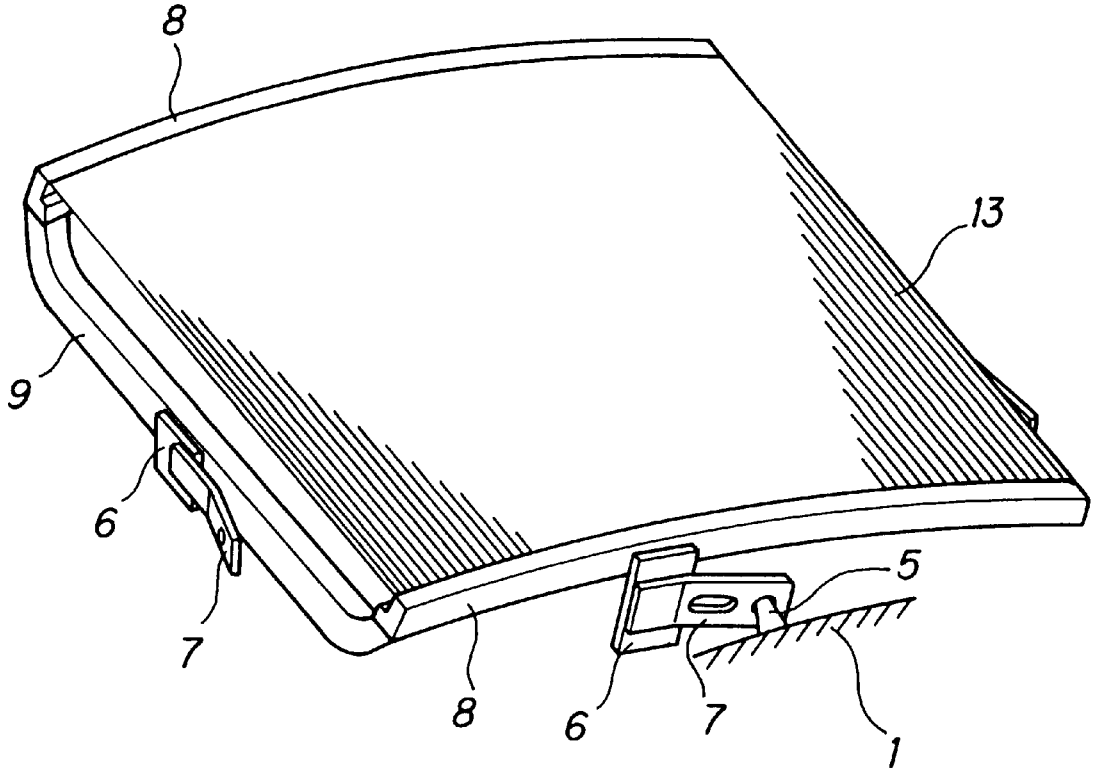
Fig. 2 (PRIOR ART)
FIG. 2 is a perspective view of a color-selecting electrode.
Figure 3A:
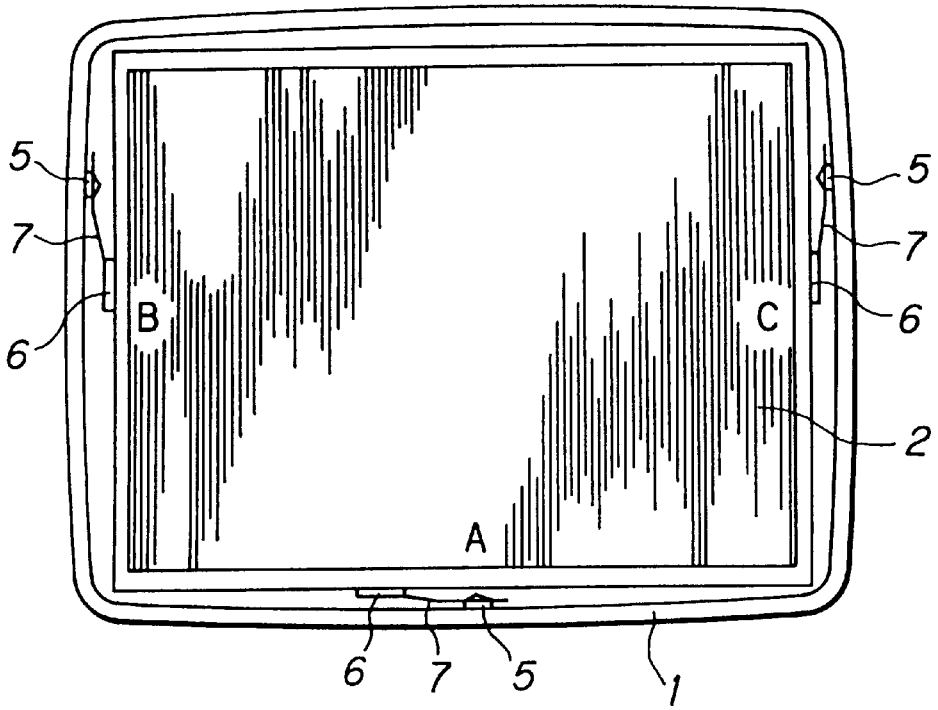
Fig. 3A (PRIOR ART)
FIGS. 3(*a*) and 3(*b*) show two different types of method of securing a color-selecting electrode to a fluorescent glass panel.
Figure 3B:
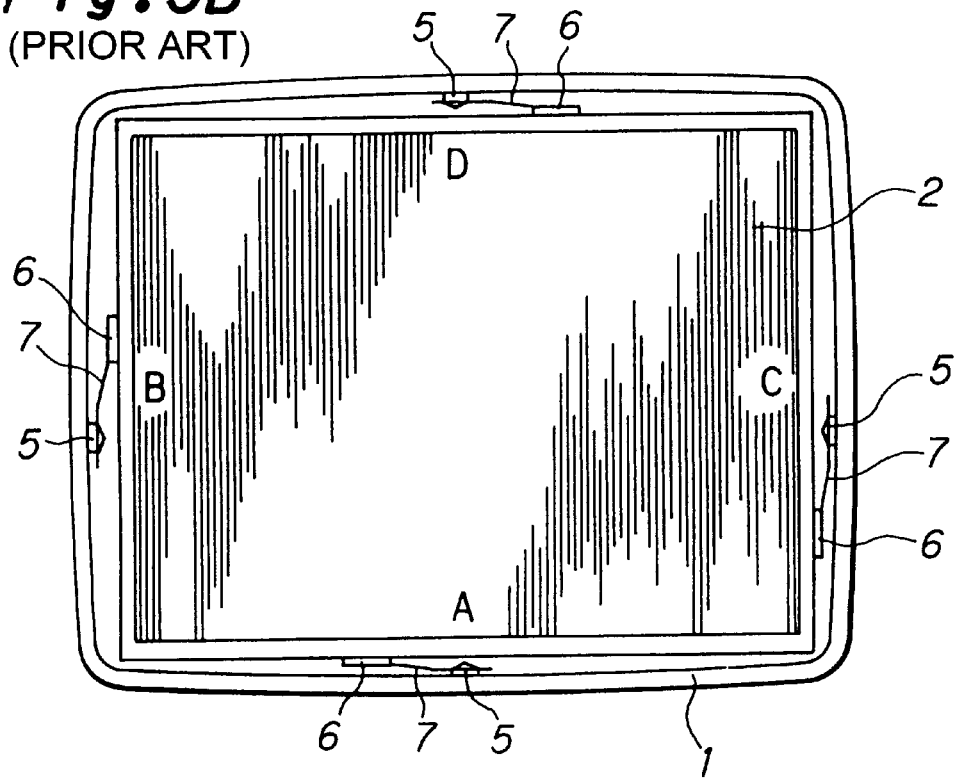
Fig. 3B (PRIOR ART)
Figure 4:
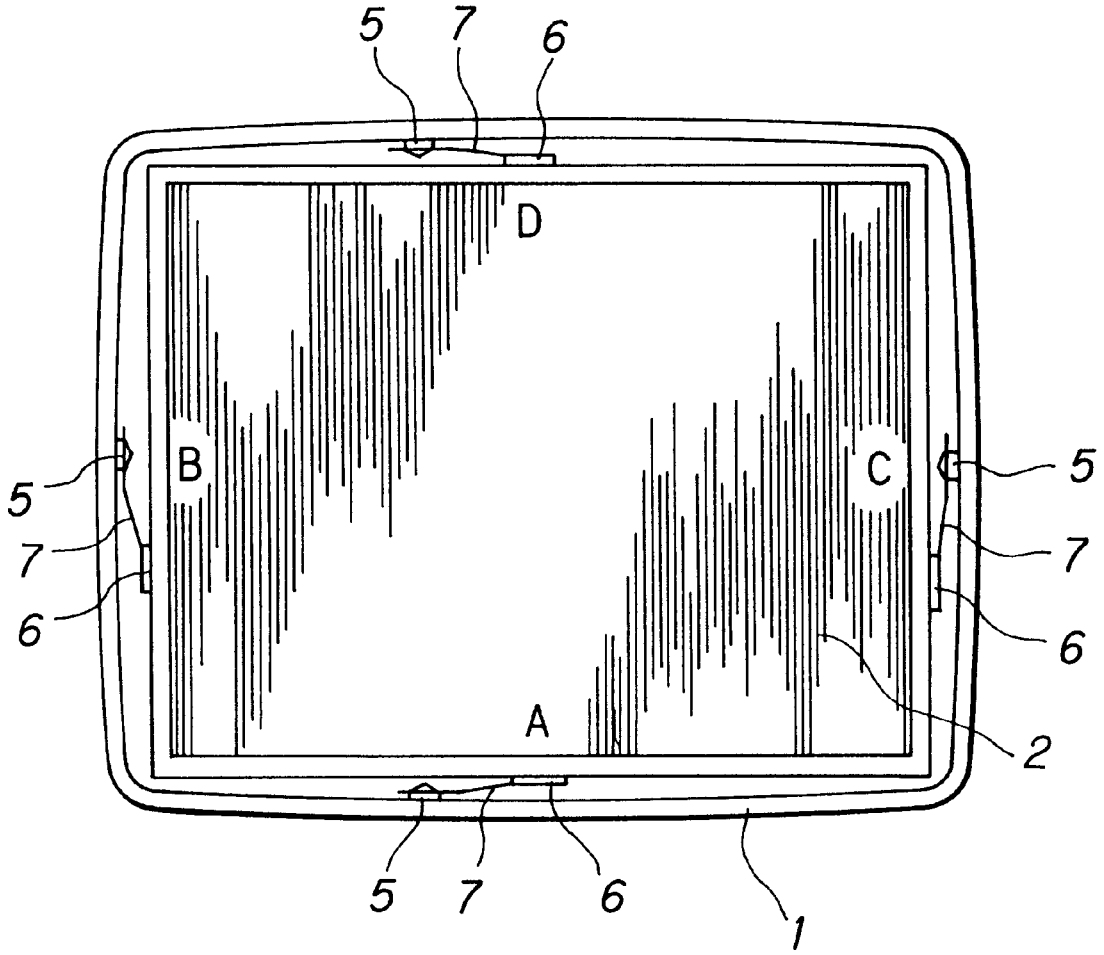
FIG. 4 shows another method of securing a color-selecting electrode to a fluorescent glass panel.
Figure 5:
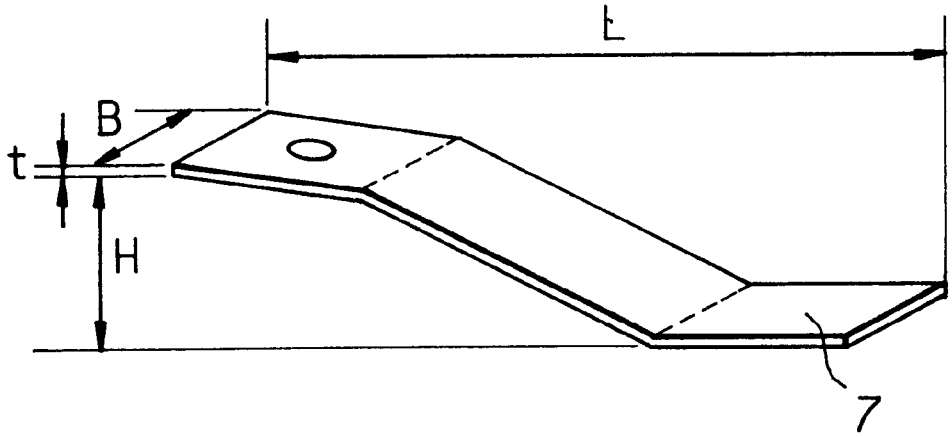
FIG. 5 is a view for explanation of the definition of the spring configuration.

The type of cathode-ray tube in Tables 1 and 2 represents the size in inches in accordance with conventional practice. The 14 inch is of the 3-pin type, the 25 inch is of the 4-pin windmill type, and the others are of the 4-pin (3+1) type. The weight is the weight (kg) of the color-selecting electrode 2. The thickness, breadth, length and height are the factors that define the spring configuration (mm) shown in FIG. 5, as has been detailed in the description of the function of the present invention.

The number N of samples (cathode-ray tubes) for each spring configuration is N=5, and an average value of the samples is shown in Tables 1 and 2 and FIGS. 8(*a*), 8(*b*), 9(*a*) and 9(*b*). With regard to No. 48 in Table 1, however, the reproducibility of the color-selecting electrode attaching and detaching operation during the formation of a fluorescent screen was excessively inferior, so that no fluorescent screen could be formed for two out of the five samples. In Tables 1 and 2 and FIGS. 8(*a*), 8(*b*), 9(*a*) and 9(*b*), cathode-ray tube samples having a spring shape factor K in the range of from 10 to 100 are shown as Examples of the present invention, and the others as Comparative Examples.

The spring shape factor K can be obtained by the following equation:

$$K=(\text{thickness})\times(\text{breadth})^2\times(\text{height})/(\text{length})/(\text{weight of color-selecting electrode})$$

It is considered that the spring shape factor K given by the above equation expresses the flexural rigidity about an axis perpendicular to an axis parallel to the longitudinal direction of an AG frame A-member 8 or an AG frame B-member 9 to which a spring 7 is secured through a holder 6, and the force with which the spring 7 is pressed against the fixing pin 5.

Accordingly, as the spring shape factor K decreases, the spring pressing force becomes weaker, and the reproducibility of the operation of attaching the color-selecting electrode 2 to the fluorescent glass panel 1 through the springs 7 becomes degraded, resulting in an increase in the offset (the amount of offset Δ) of the electron beam center from the fluorescent stripe center. In addition, it becomes impossible for the springs 7 to support the color-selecting electrode 2 satisfactorily when drop impact is applied to the cathode-ray tube, thus causing misalignment between the color-selecting electrode 2 and the fluorescent glass panel 1, which leads to misregistration of colors.

On the other hand, as the spring shape factor K increases, the impact absorption of the springs 7 becomes lower. Consequently, when a drop impact is applied to the cathode-ray tube, the springs 7 are plastically deformed, causing misalignment between the color-selecting electrode 2and the fluorescent glass panel 1, which leads to misregistration of colors.

As will be clear from FIGS. 8(*a*), 8(*b*), 9(*a*) and 9(*b*) and Tables 1 and 2, which show the results of the measurement, when the spring shape factor K is in the range of from 10 $mm^3$/kg to 100 $mm^3$/kg, it is possible to obtain a cathode-ray tube having a minimal offset of the electron beam center from the fluorescent stripe center.

If the shape factor K of the fixing springs 7 attached to the upper and lower end positions A and D is set in the range of from 10 $mm^3$/kg to 80 $mm^3$/kg, more preferably in the range of from 15 $mm^3$/kg to 40 $mm^3$/kg, in which the offset can be suppressed even more effectively, it is possible to obtain a cathode-ray tube having a minimal offset of the electron beam center from the fluorescent stripe center.

Further, if the shape factor K of the fixing springs 7 attached to the left and right end positions B and C is set in the range of from 20 $mm^3$/kg to 100 $mm^3$/kg, more preferably in the range of from 30 $mm^3$/kg to 50 $mm^3$/kg, in which the offset can be suppressed even more effectively, it is possible to obtain a cathode-ray tube having a minimal offset of the electron beam center from the fluorescent stripe center.

As will be understood from the results of the measurement, if the spring shape factor K is less than 10 $mm^3$/kg, the reproducibility of the operation of attaching the color-selecting electrode 2 to the fluorescent glass panel 1 becomes considerably degraded. It will also be understood that if the spring shape factor K exceeds 100 $mm^3$/kg, the offset Δ2 caused by a drop impact rapidly increases.

Accordingly, by setting the spring shape factor K in the range of from 10 $mm^3$/kg to 100 $mm^3$/kg, it is possible to provide a cathode-ray tube having a minimal initial offset Δ1 and a minimal drop impact offset Δ2.

Thus, by providing the color-selecting electrode 2 with fixing springs 7 having a predetermined spring shape factor K, it is possible to minimize the shift of the relative position of the fluorescent glass panel 1 and the color-selecting electrode 2 caused by the color-selecting electrode attaching and detaching operation during the fluorescent stripe forming process and thermal deformation of the color-selecting electrode 2 during a thermal process, e.g., a frit seal process, an evacuation process, etc., which is carried out after the fluorescent stripe forming process. It is also possible to minimize the shift of the relative position of the fluorescent glass panel 1 and the color-selecting electrode 2 caused by acceleration acting on the color-selecting electrode 2 when drop impact is applied to the cathode-ray tube during transport after shipment.

As has been described above, the present invention uses springs having a shape factor K in the range of from 10 $mm^3$/kg to 100 $mm^3$/kg as fixing springs for securing a color-selecting electrode to a fluorescent glass panel of a cathode-ray tube, thereby making it possible to minimize the initial offset of the electron beam center from the fluorescent stripe center and also the offset caused by a drop impact. Accordingly, it is possible to minimize the incidence of product failures and marketing claims due to misregistration of colors, and it is also possible to improve the impact resistance to a considerable extent.

Thus, the present invention is extremely suitable for application to cathode-ray tubes having a color-selecting mechanism as described above.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A cathode-ray tube having a color-selecting electrode which is secured to a fluorescent glass panel with a plurality of fixing springs between said color-selecting electrode and a corresponding plurality of fixing pins on said fluorescent glass panel, wherein said fixing springs have a shape factor K in a range of from 10 $mm^3$/kg to 100 $mm^3$/kg, wherein the shape factor K is determined by the following equation:

$K$=(a thickness of the fixing spring)×(a breadth of the fixing spring)$^2$×(a height of the fixing spring)/(the length of the fixing spring)/(a weight of said color-selecting electrode).

2. The cathode-ray tube according to claim 1, wherein a fixing spring attached to an upper end of the color-selecting electrode has a shape factor K in the range of from 10 $mm^3$/kg to 80 $mm^3$/kg.

3. A cathode-ray tube according to claim 1, wherein a fixing spring attached to a side of the color-selecting electrode has a shape factor K in the range of from 20 $mm^3$/kg to 100 $mm^3$/kg.

* * * * *